US005603162A

United States Patent [19]

Chen

[11] Patent Number: 5,603,162

[45] Date of Patent: Feb. 18, 1997

[54] UTILITY KNIFE COMBINATION

[76] Inventor: Chun C. Chen, No. 45, Lane 25, Kuo Chung 1st Road, Da Li City, Taichung Hsien, Taiwan

[21] Appl. No.: 655,944

[22] Filed: May 31, 1996

[51] Int. Cl.[6] ..... B26B 1/08

[52] U.S. Cl. ..... 30/162; 30/335

[58] Field of Search ..... 30/335, 336, 162, 30/329, 151, 2

[56] References Cited

U.S. PATENT DOCUMENTS 3,577,637 5/1971 Braginetz ..... 30/162
4,517,741 5/1985 Castelluzzo ..... 30/335 X
5,099,578 3/1992 Jan ..... 30/335 X
5,509,205 4/1996 Ragland ..... 30/335 X

*Primary Examiner*—Douglas D. Watts
*Attorney, Agent, or Firm*—Charles E. Baxley, Esq.

[57] ABSTRACT

A utility knife includes a handle having a rod slidably engaged in the front portion. A knife blade is engaged between two boards. A plate is secured to the boards and has a rear portion for engaging with the rod. A spring biases the rod to engage with the plate. The plate may be disengaged from the handle when the rod is moved away from the plate against the spring. The boards are slightly extended outward of the handle for allowing the user to grasp the boards and for disengaging the knife blade from the handle without contacting with the knife blade.

8 Claims, 2 Drawing Sheets

UTILITY KNIFE COMBINATION

BACKGROUND OF THE INVENTION

1. Field of the Invention

The present invention relates to a knife, and more particularly to a utility knife combination.

2. Description of the Prior Art

Typical utility knives comprise a handle and a knife blade slidably engaged in the handle. Some of the utility knives may further include a knob secured to the knife blade for moving the knife blade inward and outward of the handle. Two typical utility knives are disclosed in U.S. Pat. No. 5,022,156 to Kallens et al., and U.S. Pat. No. 5,099,578 to Jan. However, only the front portion of the knife blade extends outward of the handle such that the user have to grasp the knife blade when it is required to change the knife blade. In addition, the typical utility knives can be used as knife only and can not be used as screw drivers or hammers. In addition, the typical utility knife may not be used for cutting glass material.

The present invention has arisen to mitigate and/or obviate the afore-described disadvantages of the conventional utility knives.

SUMMARY OF THE INVENTION

The primary objective of the present invention is to provide a utility knife combination which includes a pair of boards engaged on the knife blade for protecting the knife blade and for allowing the user to disengage the knife blade without contacting the knife blade. The utility knife combination may be used as a screw driver, a hammer or a knife for cutting glass.

In accordance with one aspect of the invention, there is provided a utility knife combination comprising a handle including a front portion having a bulge formed thereon and having an orifice formed in the bulge, the bulge including two side portion each having a depression formed therein, a rod slidably engaged in the orifice of the bulge, the rod including at least one protrusion extended inward of the handle, a knob engaged on the bulge and secured to the rod so as to be moved in concert with the rod, the knob including two juts extended downward therefrom for engaging with the bulge so as to separate the knob from the bulge and for engaging with the depressions so as to allow the knob to be engaged with the bulge, means for biasing rod inward of the handle and for biasing the knob to engage with the bulge, a first board including a front portion slightly extended outward of the handle and including a rear portion, the first board including at least two studs extended therefrom, a plate including a front portion having at least two holes formed therein for engaging with the studs and for engaging with the rear portion of the first board so as to be secured to the first board, the plate including a rear portion having at least one impression formed therein for engaging with the protrusion of the rod so as to be secured to the handle, a knife blade including a rear portion having at least two holes formed therein for engaging with the studs so as to be secured to the studs, and a second board including at least two holes for engaging with the studs so as to be secured to the studs, the second board including a front portion slightly extended outward of the handle, for allowing the user to grasp the boards so as to disengage the knife blade from the handle. The protrusion is allowed to be engaged with the impressions of the plate when the juts of the knob are engaged with the depressions of the bulge, and the protrusion is disengaged from the plate when the knob is moved away from the bulge and when the juts are engaged with the bulge.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
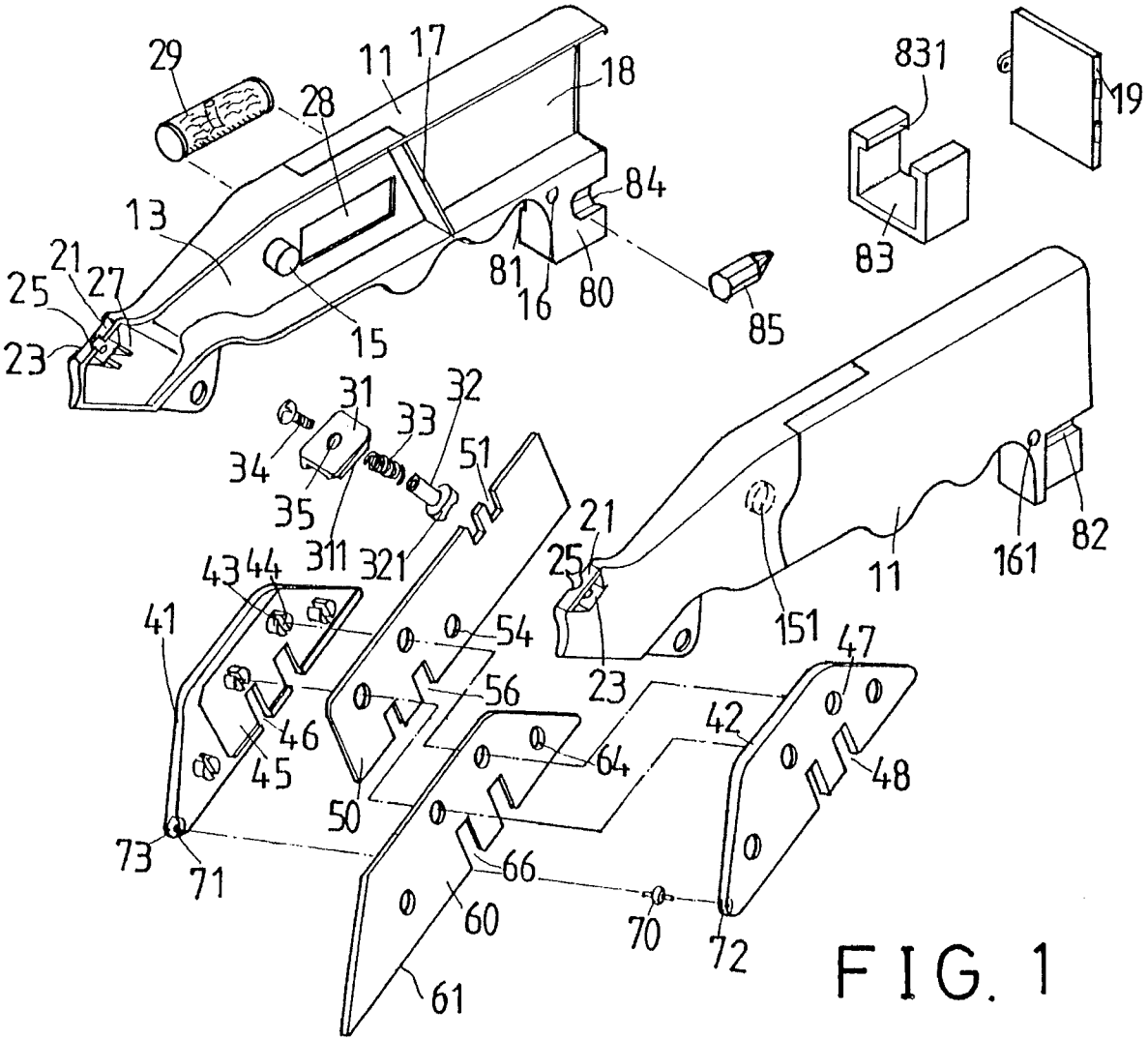
FIG. 1 is an exploded view of a utility knife combination in accordance with the present invention.
Figure 2:
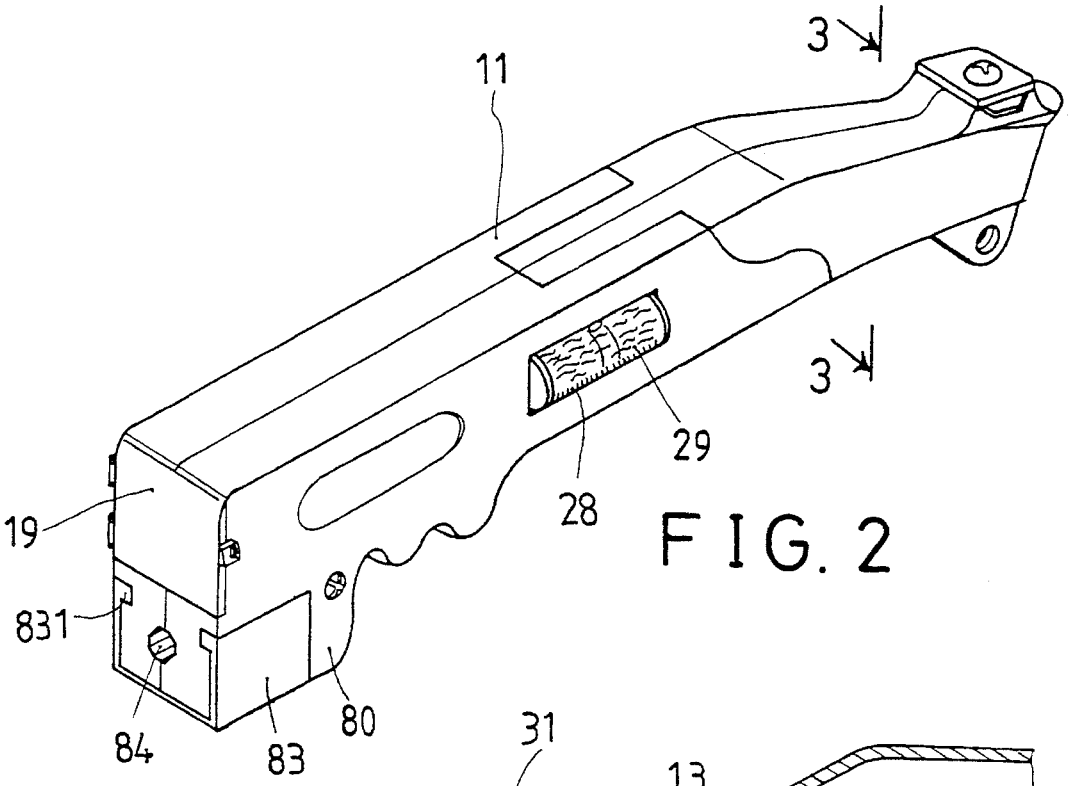
FIG. 2 is a rear perspective view of the utility knife combination.
Figure 3:
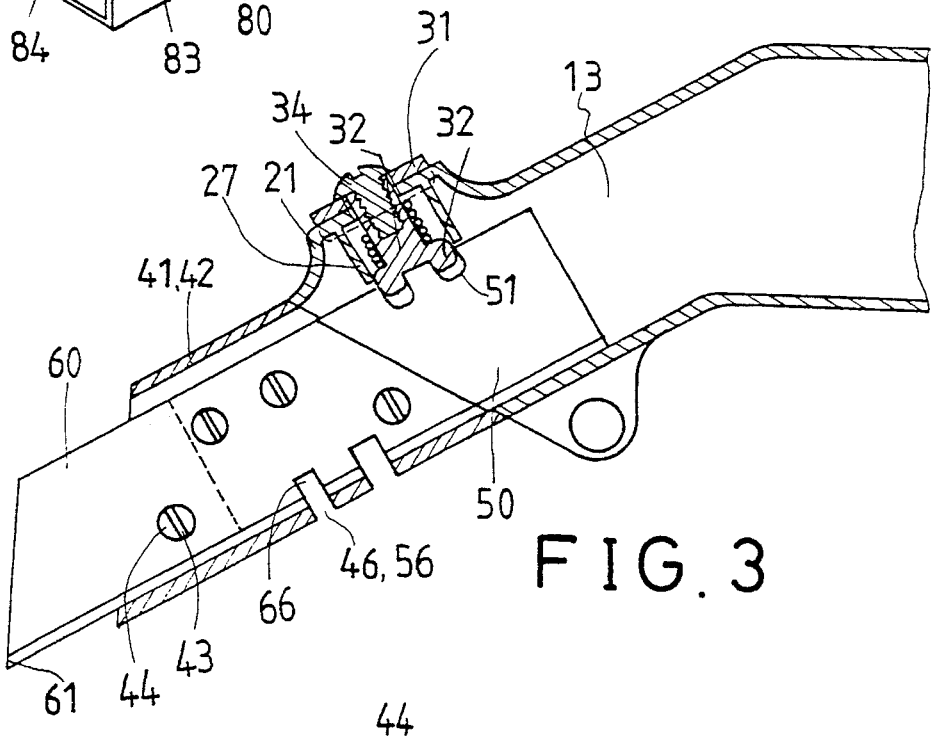
FIG. 3 is a partial cross sectional view showing the front portion of the utility knife combination.

Referring to the drawings, and initially to FIGS. 1 to 3, a utility knife combination in accordance with the present invention comprises a handle 11 including two halves secured together by projection 15 and cavity 151 and by pin element that extends through the holes 16, 161 of the handle 11. The handle 11 includes a partition 17 disposed in the middle portion so as to separate the interior into a front chamber 13 and a rear chamber 18. The rear chamber 18 may be used for storing spare knife blades. The handle 11 includes a bulge 21 formed on the front portion and having an orifice 25 formed therein for slidably engaging with a rod 32. Two panels 27 extend inward of the handle 11 from the inner or lower portion of the bulge 21. The bulge 21 includes two side portion each having a depression 23 formed therein. A knob 31 is engaged on the bulge 21 and includes a hole 35 for engaging with the rod 32. The knob 31 includes two juts 311 extended downward therefrom for engaging with the bulge 21 so as to separate the knob 31 from the bulge 21 for a small distance and for engaging with the depressions 23 so as to allow the knob 31 to be engaged with and contacted with the bulge 21 (FIG. 3). A screw 34 secures the rod 32 to the knob 31 such that the rod 32 is moved in concert with the knob 31. The panels 27 are provided for guiding the movement of the rod 32. A spring 33 is engaged with the rod 32 so as to bias the rod 32 inward of the handle 11. The rod 32 includes two protrusions 321 extended downward therefrom.

Figure 4:
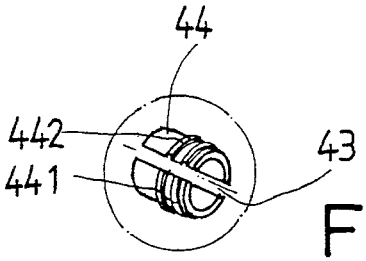
FIG. 4 is an enlarged partial perspective view illustrating the retaining stud.

A board 41 includes a recess 45 formed in one side for engaging with a front portion of a plate 50. The board 41 includes two or more studs 44 extended therefrom for engaging with holes 54 of the plate 50. The studs 44 each includes a slit 43 formed therein so as to be separated into two halves. The studs 44 each includes two annular ribs 441, 442 provided thereon (FIG. 4). A knife blade 60 includes a number of holes 64 for engaging with the studs 44 and for engaging with the annular ribs 442 so as to be secured to the studs 44. The knife blade 60 includes a blade edge 61 that has a front portion arranged to be extended outward beyond the board 41 and beyond the handle 11 (FIG. 3). Another board 42 also includes a number of holes 47 for engaging with the studs 44 and for engaging with the annular ribs 441 so as to be secured to the studs 44. The plate 50 includes two impressions 51 formed in the rear and upper portion for engaging with the protrusions 321 of the rod 32 such that the boards 41, 42 and the knife blade 60 and the plate 50 may all be secured to the handle 11 by the protrusions 321 of the rod 32, best shown in FIG. 3. The front portions of the boards 41, 42 are partially extended outward of the handle 11 for allowing the user to grasp the boards 41, 42 so as to disengage the knife blade 61 from the handle 11. The boards 41, 42 and the knife blade 60 and the plate 50 each includes one or more notches 46, 48, 66, 56 aligned with each other (FIG. 3) for engaging with glass material to be cut.

It is to be noted that the protrusions 321 are allowed to be engaged with the impressions 51 of the plate 50 when the juts 311 of the knob 31 are engaged with the depressions 23 of the bulge 21. The protrusions 321 are disengaged from the plate 50 when the knob 31 is moved away from the bulge 21 and rotated for about 90 degrees. At this moment, the juts 311 are engaged with the bulge 21 so as to separate the knob 31 from the bulge 221 and so as to separate the protrusions 321 from the plate 50.

The boards 41, 42 each includes a front end having a cavity 71, 72 and an aperture 73 for engaging with a glass cutter 70. The glass cutter 70 is secured to the boards 41, 42 when the knife blade 60 is disengaged from the boards 41, 42. The board 42 may be engaged with the annular ribs 442 of the studs 44 so as to be secured to the board 41 when the knife blade 60 is disengaged from the boards 41, 42.

As shown in FIGS. 1 and 2, the handle 11 includes an opening 28 formed in one side portion for engaging with a level 29 and includes a block 80 formed in the rear and bottom portion. The block 80 includes an engaging hole 84 formed therein for engaging with a screw driver bit 85 such that the utility knife may be used as a screw driver. The block 80 includes two side portions each having a channel 81, 82 formed therein. A U-shaped steel frame 83 is engaged onto the block 80 and includes a pair of flanges 831 for engaging with the channels 81, 82 such that the steel frame 83 may be used for hammering purposes. A cover 19 is secured to the rear portion of the handle 11 for enclosing the rear chamber 18.

Accordingly, the utility knife combination has a knife blade engaged between a pair of boards so as to be protected by the boards and so as to allow the user to disengage the knife blade without contacting the knife blade. The knife can also be used as a screw driver, a hammer or a knife for cutting glass material.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A utility knife combination comprising:

a handle including a front portion having a bulge formed thereon and having an orifice formed in said bulge, said bulge including two side portion each having a depression formed therein, a rod slidably engaged in said orifice of said bulge, said rod including at least one protrusion extended inward of said handle, a knob engaged on said bulge and secured to said rod so as to be moved in concert with said rod, said knob including two juts extended downward therefrom for engaging with said bulge so as to separate said knob from said bulge and for engaging with said depressions so as to allow said knob to be engaged with said bulge, means for biasing rod inward of said handle and for biasing said knob to engage with said bulge, a first board including a front portion slightly extended outward of said handle and including a rear portion, said first board including at least two studs extended therefrom, a plate including a front portion having at least two holes formed therein for engaging with said studs and for engaging with said rear portion of said first board so as to be secured to said first board, said plate including a rear portion having at least one impression formed therein for engaging with said protrusion of said rod so as to be secured to said handle, a knife blade including a rear portion having at least two holes formed therein for engaging with said studs so as to be secured to said studs, and a second board including at least two holes for engaging with said studs so as to be secured to said studs, said second board including a front portion slightly extended outward of said handle, for allowing the user to grasp said boards so as to disengage said knife blade from said handle, said protrusion being allowed to be engaged with said impressions of said plate when said juts of said knob are engaged with said depressions of said bulge, and said protrusion being disengaged from said plate when said knob is moved away from said bulge and when said juts are engaged with said bulge.

2. A utility knife combination according to claim 1, wherein said first and said second boards each includes a front end having a cavity formed therein and having an aperture formed therein for engaging with and for securing a glass cutter when said knife blade is disengaged from said first and said second boards.

3. A utility knife combination according to claim 1, wherein said handle includes a side portion having an opening formed therein and includes a level secured in said opening.

4. A utility knife combination according to claim 1, wherein said handle includes a rear portion having a block formed therein, said block including an engaging hole formed therein for engaging with a screw driver bit so as to form a screw driver.

5. A utility knife combination according to claim 4, wherein said block includes two side portions each having a channel formed therein, a U-shaped steel frame is engaged onto said block and includes a pair of flanges for engaging with said channels, said steel frame is provided for hammering purposes.

6. A utility knife combination according to claim 1, wherein said handle includes a middle portion having a partition provided therein so as to separate an interior of said handle into a front chamber and a rear chamber, said rear chamber is provided for storing spare knife blades.

7. A utility knife combination according to claim 1, wherein said studs each includes a slit formed therein so as to be separated into two halves, said studs each includes two annular ribs provided thereon for engaging with said knife blade and said second board.

8. A utility knife combination according to claim 1, wherein said first and said second boards and said knife blade and said plate each includes at least one notch aligned with each other.

* * * * *